US007314852B1

(12) United States Patent
Cummings et al.

(10) Patent No.: US 7,314,852 B1
(45) Date of Patent: Jan. 1, 2008

(54) GLASS CLEANING COMPOSITION

(75) Inventors: Gerald W. Cummings, Racine, WI (US); Frank J. Steer, Racine, WI (US); Francis J. Randall, Racine, WI (US); Loretta G. Lynch, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 11/531,764

(22) Filed: Sep. 14, 2006

(51) Int. Cl.

| | |
|---|---|
| ***C11D 1/66*** | (2006.01) |
| ***C11D 1/88*** | (2006.01) |
| ***C11D 3/28*** | (2006.01) |
| ***C11D 7/26*** | (2006.01) |
| ***C11D 7/50*** | (2006.01) |

(52) U.S. Cl. ..... 510/163; 510/181; 510/182; 510/433; 510/500

(58) Field of Classification Search ..... 510/163, 510/181, 182, 433, 500
See application file for complete search history.

(56) References Cited

U.S. PATENT DOCUMENTS

| | | | |
|---|---|---|---|
| 5,093,031 | A | 3/1992 | Login et al. |
| 5,252,245 | A | 10/1993 | Garabedian, Jr. et al. |
| 5,389,688 | A | 2/1995 | Narayanan |
| 5,435,934 | A | 7/1995 | Jon et al. |
| 5,437,807 | A | 8/1995 | Garabedian, Jr. et al. |
| 5,468,423 | A | 11/1995 | Garabedian, Jr. et al. |
| 5,470,508 | A | 11/1995 | Narayanan et al. |
| 5,503,778 | A | 4/1996 | Liu et al. |
| 5,573,710 | A | 11/1996 | McDonell |
| 5,585,342 | A | 12/1996 | Choy et al. |
| 5,641,742 | A | 6/1997 | Adamy et al. |
| 5,691,289 | A | 11/1997 | Purcell et al. |
| 5,750,482 | A | 5/1998 | Cummings |
| 5,789,363 | A | 8/1998 | Cala et al. |
| 5,814,588 | A | 9/1998 | Cala et al. |
| 5,908,819 | A | 6/1999 | Reynolds et al. |
| 5,955,410 | A | 9/1999 | Dingess et al. |
| 6,017,863 | A | 1/2000 | Cala et al. |
| 6,071,867 | A | 6/2000 | Purcell et al. |
| 6,090,765 | A | 7/2000 | Black et al. |
| 6,309,425 | B1 | 10/2001 | Murphy |
| 6,391,841 | B1 | 5/2002 | Durbut et al. |
| 6,399,563 | B1 * | 6/2002 | Durbut et al. ..... 510/413 |
| 6,432,897 | B1 | 8/2002 | Cable |
| 6,693,068 | B1 | 2/2004 | Ryan et al. |
| 6,773,873 | B2 | 8/2004 | Seijo et al. |

(Continued)

FOREIGN PATENT DOCUMENTS

| | | |
|---|---|---|
| JP | 6313197 | 11/1994 |

OTHER PUBLICATIONS

"Through the Response Surface with Test Tube and Pipe Wrenchr", CHEMTECH, Aug. 1980, p. 488-497.

*Primary Examiner*—Brian Mruk

(57) ABSTRACT

A glass cleaning composition is disclosed for removing soils and dirt from glass surfaces without leaving a visible streak. The cleaning composition contains an ethylene glycol ether, an N-alkyl pyrrolidone, a surfactant, and water. Optionally the composition can also include a co-solvent, a pH adjusting agent, a dye, a fragrance, and other ingredients that enhances the performance and elegance of the composition. The composition make use of a synergetic effect of combining the ethylene glycol ether, N-alkyl pyrrolidone and surfactant to improve the soil removal performance of the composition while remaining substantially streak-free.

14 Claims, 8 Drawing Sheets

U.S. PATENT DOCUMENTS

| | | | |
|---|---|---|---|
| 6,780,825 | B2 | 8/2004 | Piterski et al. |
| 6,821,937 | B2 | 11/2004 | Gross |
| 6,824,623 | B1 | 11/2004 | Gross et al. |
| 2002/0151446 | A1 | 10/2002 | Piterski et al. |
| 2003/0125225 | A1 | 7/2003 | Xu et al. |
| 2004/0058833 | A1 | 3/2004 | Gross et al. |
| 2004/0224865 | A1 | 11/2004 | Roeder et al. |

* cited by examiner

Table 1 - Monte Carlo Screening Design

| run | EH | hexylene glycol | MEA | Mackam 2CSF | NOP | APG | SDBS | Cloud point | Streak | GKS |
|---|---|---|---|---|---|---|---|---|---|---|
| 1 | 0.450 | 0.000 | 0.600 | 0.950 | 0.000 | 0.250 | 0.050 | 200 | 0.22 | 0.299 |
| 2 | 0.900 | 0.000 | 0.000 | 0.675 | 0.100 | 0.000 | 0.050 | 86 | 0.33 | 0.439 |
| 3 | 0.450 | 0.125 | 0.600 | 1.500 | 0.400 | 0.125 | 0.150 | 163 | 0.83 | 0.521 |
| 4 | 0.225 | 0.000 | 0.000 | 1.120 | 0.600 | 0.125 | 0.100 | 127 | 0.78 | 0.495 |
| 5 | 0.000 | 0.125 | 0.000 | 1.120 | 0.600 | 0.000 | 0.100 | 146 | 0.33 | 0.428 |
| 6 | 0.000 | 0.225 | 0.800 | 0.400 | 0.400 | 0.000 | 0.000 | 103 | 0.06 | 0.236 |
| 7 | 0.450 | 0.500 | 0.400 | 0.950 | 0.600 | 0.000 | 0.200 | 113 | 1.72 | 0.664 |
| 8 | 0.675 | 0.350 | 0.000 | 1.120 | 0.400 | 0.250 | 0.050 | 110 | 1.33 | 0.552 |
| 9 | 0.225 | 0.225 | 0.200 | 0.400 | 0.300 | 0.000 | 0.000 | 84 | 0.11 | 0.171 |
| 10 | 0.225 | 0.125 | 0.200 | 1.120 | 0.300 | 0.000 | 0.100 | 169 | 0.83 | 0.197 |
| 11 | 0.225 | 0.225 | 0.400 | 0.675 | 0.600 | 0.000 | 0.000 | 86 | 0.11 | 0.328 |
| 12 | 0.450 | 0.000 | 0.600 | 1.120 | 0.300 | 0.000 | 0.200 | 163 | 0.28 | 0.609 |
| 13 | 0.675 | 0.350 | 0.800 | 0.950 | 0.300 | 0.000 | 0.050 | 101 | 0.21 | 0.506 |
| 14 | 0.675 | 0.000 | 0.600 | 1.500 | 0.000 | 0.250 | 0.200 | 200 | 0.33 | 0.477 |
| 15 | 0.450 | 0.000 | 0.400 | 1.120 | 0.100 | 0.000 | 0.000 | 190 | 0.33 | 0.333 |
| 16 | 0.000 | 0.350 | 0.600 | 0.400 | 0.100 | 0.500 | 0.000 | 200 | 0.22 | 0.301 |
| 17 | 0.900 | 0.125 | 0.000 | 0.400 | 0.600 | 0.250 | 0.150 | 42 | 0.56 | 0.667 |
| 18 | 0.900 | 0.350 | 0.200 | 1.120 | 0.300 | 0.125 | 0.050 | 108 | 0.56 | 0.797 |
| 19 | 0.450 | 0.125 | 0.200 | 1.120 | 0.300 | 0.125 | 0.100 | 200 | 0.61 | 0.477 |
| 20 | 0.675 | 0.500 | 0.000 | 1.500 | 0.000 | 0.000 | 0.100 | 20 | 2.83 | 0.461 |
| Windex | | | | | | | | 200 | 0.17 | 0.294 |

Cloud point is in °F; Streaking is a panel evaluation on a 0 to 5 scale with zero being best; GKS is the ratio of greasy kitchen soil (GKS) removed by the glass cleaning composition to that removed by a commercial all purpose cleaner

Figure 3

Table 2 – Monte Carlo Screening Results

| **Effects** | **when changed from** | | | **Cloud Pt** | **Streak** | **GKS** |
|---|---|---|---|---|---|---|
| | **low** | **high** | | higher bet. | low better | high better |
| **EH** | 0 | 0.9 | | **-65.9** | **-0.22** | **0.35** |
| Hexylene glycol | 0 | 0.5 | | -66.8 | 1.32 | 0.08 |
| MEA | 0.4 | 0.8 | | 21.5 | -0.43 | 0.02 |
| **MacKam 2CSF** | 0.4 | 1.5 | | **62.9** | **0.58** | **0.11** |
| **NOP** | 0 | 0.6 | | **-17.4** | **-0.51** | **0.24** |
| **APG** | 0 | 0.5 | | **73.7** | **0.58** | **0.32** |
| SDBS | 0 | 0.2 | | -0.5 | 0.65 | 0.1 |

Figure 4

D-Optimal Design to fit Quadratic - 19 runs with three center points

| run | EH | MacKam | NOP | APG | Hex Gly | MEA | SDBS | experimental GKS | experimental Streak | |
|---|---|---|---|---|---|---|---|---|---|---|
| 1 | 0.6 | 3 | 0.2 | 0.1 | 0 | 0.6 | 0.1 | 0.75 | 0.23 | |
| 2 | 0.6 | 1 | 0.1 | 0.3 | 0 | 0.6 | 0.1 | 0.50 | 0.43 | |
| 3 | 0 | 1 | 0 | 0.1 | 0 | 0.6 | 0.1 | 0.35 | 0.50 | |
| 4 | 0.3 | 2 | 0.1 | 0.2 | 0 | 0.6 | 0.1 | 0.29 | 0.13 | center point |
| 5 | 0 | 1 | 0.2 | 0.3 | 0 | 0.6 | 0.1 | 0.31 | 0.07 | |
| 6 | 0 | 3 | 0 | 0.2 | 0 | 0.6 | 0.1 | 0.21 | 0.73 | |
| 7 | 0.3 | 2 | 0.1 | 0.2 | 0 | 0.6 | 0.1 | 0.29 | 0.37 | |
| 8 | 0 | 3 | 0.2 | 0.3 | 0 | 0.6 | 0.1 | 0.23 | 0.63 | |
| 9 | 0.6 | 2 | 0 | 0.1 | 0 | 0.6 | 0.1 | 0.23 | 0.43 | |
| 10 | 0.3 | 3 | 0 | 0.1 | 0 | 0.6 | 0.1 | 0.25 | 0.73 | |
| 11 | 0.6 | 1 | 0.2 | 0.1 | 0 | 0.6 | 0.1 | 0.35 | 0.07 | |
| 12 | 0.6 | 2 | 0.2 | 0.3 | 0 | 0.6 | 0.1 | 0.42 | 0.57 | |
| 13 | 0.6 | 3 | 0 | 0.3 | 0 | 0.6 | 0.1 | 0.25 | 0.80 | |
| 14 | 0.6 | 1 | 0 | 0.2 | 0 | 0.6 | 0.1 | 0.29 | 0.43 | |
| 15 | 0.3 | 1 | 0 | 0.3 | 0 | 0.6 | 0.1 | 0.21 | 0.50 | |
| 16 | 0 | 2 | 0 | 0.3 | 0 | 0.6 | 0.1 | 0.21 | 0.80 | |
| 17 | 0.3 | 2 | 0.1 | 0.2 | 0 | 0.6 | 0.1 | 0.21 | 0.53 | center point |
| 18 | 0 | 2 | 0.2 | 0.1 | 0 | 0.6 | 0.1 | 0.18 | 0.33 | |
| 19 | 0.3 | 2 | 0.1 | 0.2 | 0 | 0.6 | 0.1 | 0.18 | 0.63 | center point |
| Windex | | | | | | | | 0.16 | 0.03 | |

Formulas also contain 3% isopropanol, 0.3% ammonia and 0.05% fragrance

Figure 5

GLASS CLEANING COMPOSITION

BACKGROUND

1. Technical Field

This application relates to an improved glass cleaning composition that contains either ethylene glycol monohexyl ether (EGHE), or N-Octyl Pyrrolidone (NOP), or a combination of both. The composition further comprises a surfactant. The improved formulation makes use of an unexpected synergetic effect of the aforementioned components to improve cleaning and reduce streaking when the composition is used to clean glass surfaces.

2. Description of the Related Art

Keeping glass clean and shiny significantly enhances the appearance of a home or a car. A popular method of cleaning glass is by applying a glass cleaning composition on the surface of the glass and wiping it off using soft, clean and lint-free clothes or towels. Conventional cleaning compositions are formulated to remove dirt and soils from the glass surface, wherein the dirt and soils may comprise either organic or inorganic substances, or a mixture of both.

Many glass cleaning products are sold commercially, which typically contain a surfactant, an organic solvent or solvent system, a pH-adjusting agent such as ammonia or acetic acid, a detergent builder, a hydrotrope, a fragrance, a dye, and water. WINDEX® and GLASS PLUS® are representative commercially available products.

The effectiveness of the cleaning composition can be reduced by a phenomenon called streaking, wherein a noticeable streak of dirt remains attached to the glass surface after cleaning. While the streak maybe residual dirt not completely removed by the cleaning composition, it is often caused by the improperly formulated cleaning composition itself, such as deposition of solid components of the composition or hazing caused by residual solvent.

Improving cleaning performance without leaving visible streaks has always been an important goal in formulating glass cleaners. Finding a suitable solvent or solvent system has been a key challenge to achieving better cleaning without streaking. For example, the commercially available glass cleaning products sold under the GLASS PLUS® trademarks have a organic solvent system comprising a mixture of ethylene glycol monobutyl ether (EGBE) and isopropyl alcohol. U.S. Pat. No. 5,750,482 to Cummings discloses the formulation of ethylene glycol monohexyl ether (EGHE) into a glass cleaning composition to significantly improve the cleaning performance of a glass cleaner without streaking. Cummings also discloses the use of EGBE as a high boiling point organic co-solvent to further enhance the cleaning performance of the composition.

EGBE is recently being reviewed by the Environmental Protection Agency (EPA) for potential health risks. Providing a component to replace EGBE in the formulation while maintaining or improving the glass cleaning performance of a composition without causing streaking is a key need.

Thus, there is a need for an improved glass cleaning composition that can both improve cleaning and remain substantially streak-free.

SUMMARY OF THE DISCLOSURE

It is an object of the present invention to provide a glass cleaning composition that effectively removes soils from glass surfaces.

It is a further object of the present invention to clean the glass surface to provide a haze-free or streak-free finish.

A primary objective of the present invention is to provide a component to replace EGBE in a glass cleaning composition while maintaining or improving the glass cleaning performance of the composition without causing streaking.

The improved glass cleaning composition comprises an ethylene glycol ether as a high boiling point organic solvent, an N-alkyl pyrrolidone, a surfactant, and water. The composition may also contain other organic co-solvents, e.g. lower boiling alcohols and moderately high boiling glycols and glycol ethers, especially water-soluble organic co-solvents. Preferably, the composition further contains additional components to improve the performance of the product. Thus, the compositions herein disclosed may contain pH modifying agents in an amount effective to achieve a desired pH, hydrotropes, antimicrobial agents, dyes, perfumes and stabilizers such as buffers.

Further, the composition is suitable for cleaning glass surfaces as the composition is substantially streak-free and haze-free subsequent to application and wiping with a paper or fabric towel. Moreover, the compositions are easy to use by the consumer, as excessive buffing of the composition applied to the glass surface with the paper or fabric towel is not required. That is, the consumer is required to buff the glass surface only moderately or gently with the paper or fabric towel in order to achieve a clean, streak-free and haze-free glass surface.

The compositions of the present invention are also suitable for cleaning other hard surfaces including metallic surfaces, such as aluminum, steel and chrome, countertops, kitchen appliances, furniture, bathroom fixtures, walls, porcelain, ceramic tiles, plastic, vinyl, enameled, and other surfaces where low residue and non-streaking are desirable.

Other advantages and features of the disclosed methods and compositions will be described in greater detail below. It should be noted that all concentrations discussed hereinafter are based on weight.

BRIEF DESCRIPTION OF THE DRAWINGS

For a more complete understanding of the disclosed solutions and methods, reference should now be made to the accompanying drawings, wherein:

FIG. 3 graphically illustrates a Monte Carlo approach to screen a total of seven potential components consisting of EGHE, NOP, a co-solvent, a pH adjusting agent, and three surfactants;

FIG. 4 graphically illustrates the identification of EGHE, NOP, disodium cocoamphodipropionate (MacKam 2CSF), and alkyl polyglycoside (APG) as the four most important components to contribute to the soil removal and streak reducing performance of a composition;

FIG. 5 graphically illustrates a four variable D-optimal Design with EGHE, NOP, MacKam 2CSF and APG as the four variables to identify and characterize a potential synergetic effect;

It should be understood, of course, that this disclosure is not limited to the particular embodiments illustrated herein.

DETAILED DESCRIPTION OF THE PRESENTLY PREFERRED EMBODIMENTS

Disclosed glass cleaner compositions comprise an ethylene glycol ether such as EGHE, an N-alkyl pyrrolidone such as NOP, a surfactant, and water. Preferably, the disclosed composition includes a pH modifying agent, especially an alkalinity agent, and an organic co-solvent. The disclosed improvement relates to an unexpected synergetic effect of combining an ethylene glycol ether, an N-alkyl pyrrolidone, and a surfactant in a glass cleaning composition.

It has been found, as will be further considered in the examples below, the Coupling Index of a solvent or solvent system to be a useful measure of the ability of that solvent or solvent system to affect cleaning when incorporated in a glass cleaning composition. To determine this index, a 1:1 blend of oil and water was titrated with the solvent under investigation until a clear single phase system is obtained. Although various oils may be employed for determining this index, it is found that corn oil correlates best with the ability of a solvent to affect the cleaning performance of a composition containing such solvent.

Figure 1:
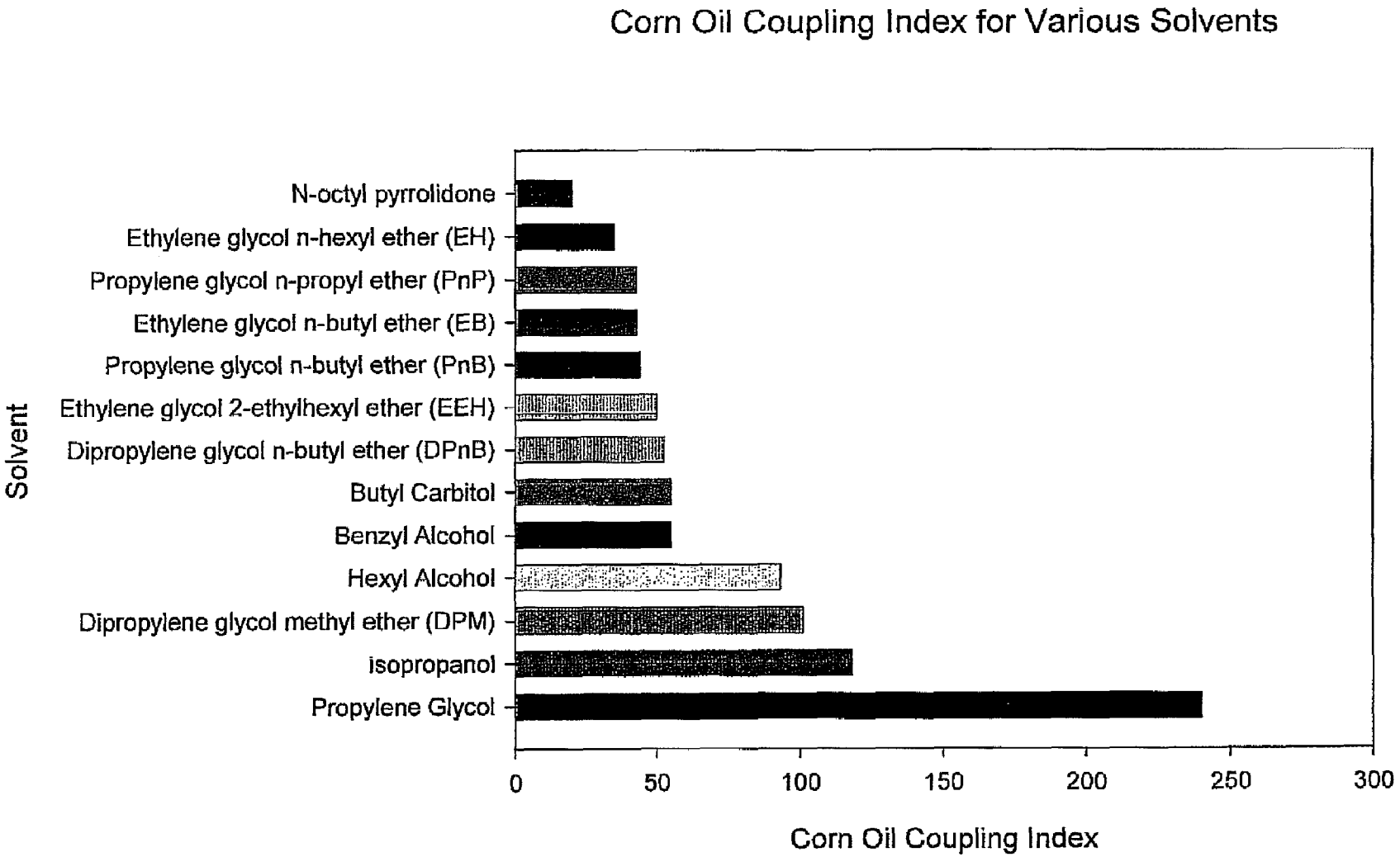
FIG. 1 graphically illustrates a comparison of Corn Oil Coupling Index of various solvents.

FIG. 1 is a bar graph chart of the Corn Oil Coupling Index (COCI) of various solvents, wherein the COCI is the number of milliliters of solvent required to produce a clear single phase solution with a mixture of 5 milliliters of corn oil and 5 milliliters of water. A lower COCI indicates greater ability of a solvent to enhance the cleaning performance of a glass cleaning composition.

The ethylene glycol ether component of the glass cleaning composition can be regarded as the primary organic solvent herein. The ethyleneglycol ether may have a formula of $HO(CH_2CH_2O)_nR$, wherein n is an integer ranging from 1 to 2 and R is a $C_{1-10}$ alkyl group. Even a low level of ethylene glycol ether incorporated in a glass cleaning composition enhances the performance of the composition significantly with respect to its soil removal capacity. Preferably, EGHE is used as the ethylene glycol ether in the composition because of its substantial cleaning capability as it exhibits the second lowest COCI in FIG. 1.

Alternatively, the ethylene glycol ether may be chosen from a group including, but not limited to, ethylene glycol monopropyl ether, ethylene glycol monobutyl ether, diethylene glycol monoethyl ether, diethylene glycol monobutyl ether, propylene glycol monopropyl ether, propylene glycol monobutyl ether, and dipropylene glycol monomethyl ether.

As an example, ethylene glycol monohexyl ether is incorporated in the composition in an amount ranging from about 0.01 to about 10%. Preferably, this solvent is present in an amount ranging from about 0.1 to about 5%, most preferably in an amount ranging from about 0.25 to about 1%.

In additional to the primary organic solvent, an organic co-solvent, either a low boiling point alcohol, or a high boiling point glycol, or a mixture of both, can be included in the formulation.

The low boiling point co-solvent may be made of $C_{1-4}$ alcohols. The low boiling solvent is present in an amount ranging from 0 to about 10%, preferably in an amount ranging from about 0.1 to about 8%, most preferably in an amount ranging from about 1 to about 5% by weight of the composition. Suitable low boiling co-solvents include methyl alcohol, ethyl alcohol, isopropyl alcohol, n-butyl alcohol and sec-butyl alcohol. Isopropyl alcohol is preferred.

The high boiling point organic co-solvent is an alkylene glycol, such as an ethylene or propylene glycol, said high boiling point organic co-solvent typically having a boiling point from about 120 to about 230° C., preferably from about 150 to 200° C. Further, the high boiling point organic co-solvent should preferably be completely soluble in water at 20° C. The high boiling point co-solvent is typically present in an amount ranging from 0 to about 10%, preferably in an amount ranging from about 0.1 to about 5%, most preferably in an amount ranging from about 1 to about 3% of the composition. Generally, compositions containing the high boiling co-solvent will also contain the low boiling co-solvent, to provide a co-solvent mixture or system.

N-alkyl pyrrolidone is found to be particularly effective in enhancing cleaning performance and reducing streaking characteristic of a glass cleaning composition. A low level of N—$C_{1-12}$ alkyl pyrrolidone incorporated in a glass cleaning composition enhances the cleaning performance of the composition and reduces streaking. Preferably, N-octylpyrrolidone (NOP) is used as the N-alkyl pyrrolidone in the composition because it substantially enhances the cleaning performance of a composition. As demonstrated in FIG. 1, NOP exhibits one of the lowest COCI which make it an excellent organic solvent to removal soil when formulated in a cleaning composition. Moreover, it is believed that N-alkyl-2-pyrrolidone can also contribute to the cleaning performance of the composition through at least three other mechanisms, each of which will be discussed separately below.

Figure 2:
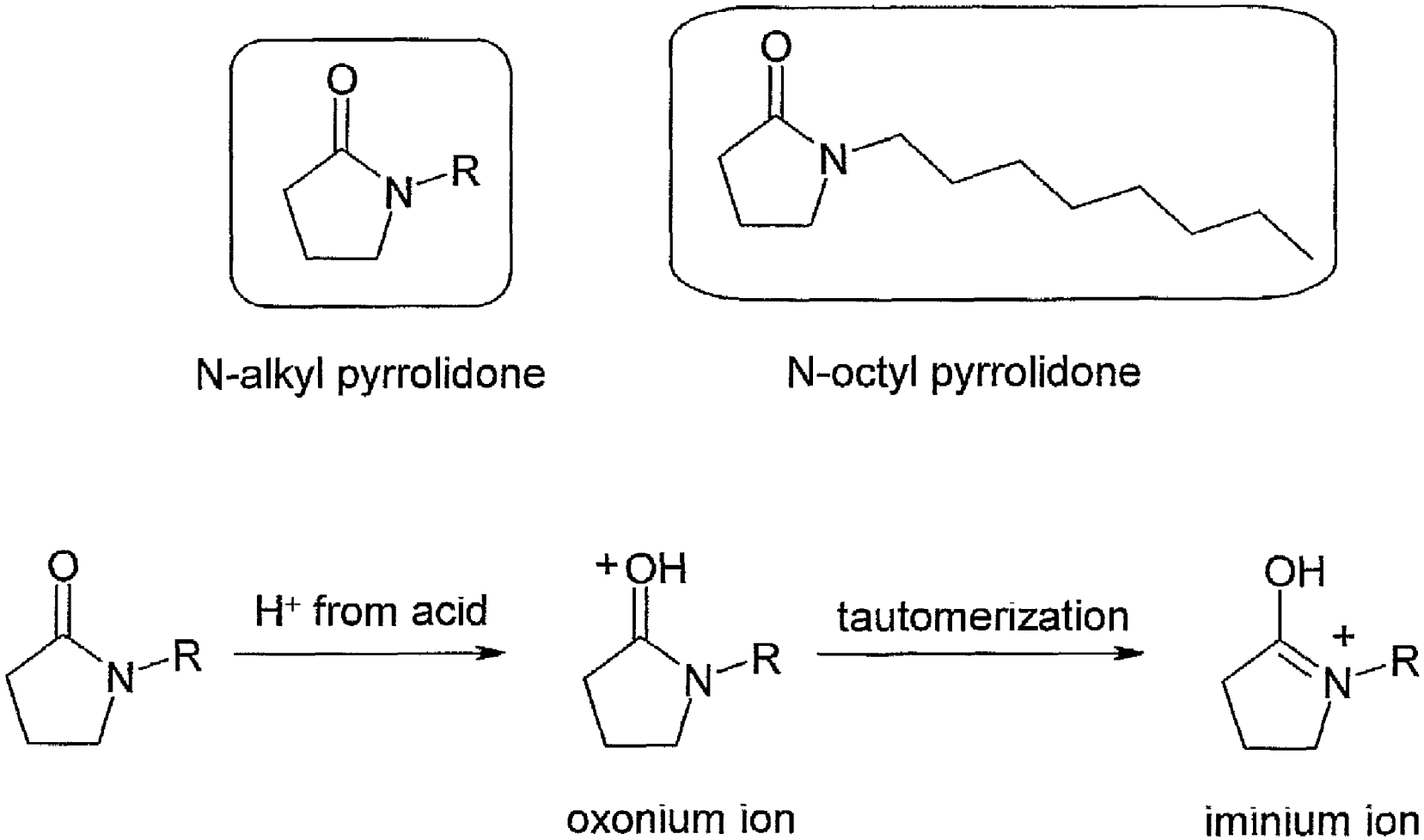
FIG. 2 graphically illustrates the chemical structure of N-alkyl pyrrolidone and the mechanism of a chemical reaction between N-alkyl pyrrolidone and an acid.

FIG. 2 illustrates the chemical structure of N-alkyl pyrrolidone as a five-member ring lactam with an alkyl substituted tertiary nitrogen atom. The N-alkyl pyrrolidone functions as a solvent as well as an active surfactant. The pyrrolidone ring of the N-alkyl pyrrolidone functions as the hydrophilic head and the alkyl group (R) functions as the hydrophobic tail. One well recognized example of this type of surfactant is N-Octyl-2-pyrrolidone.

N-alkyl pyrrolidone also functions as a hydrophobic base that can penetrate soils to neutralize free acids effectively. FIG. 2 illustrates a possible mechanism for such neutralization, wherein the oxygen atom of the acetyl group may receive a proton from the free acid, forming an oxonium ion, which quickly tautomerizes into a more stable iminium ion through double-bond migration. Subsequently, the resulting iminium ion can be readily removed from the glass surface with the rest of the cleaning composition.

In addition, N-alkyl pyrrolidone is a good ligand that can coordinate the transition metal ions in the soil and transfer them into the composition for easy removal. Both the oxygen and nitrogen atom in a N-alkyl pyrrolidone molecule exhibit strong coordinating ability towards transition metal ions. Moreover, the orientation of the oxygen and nitrogen atom within an N-alkyl pyrrolidone molecule enables them to coordinate a transition metal ion through a more effective chelation mechanism.

Although NOP is preferably utilized in the composition, other N-alkyl pyrrolidones, apparent to those skilled in the art, can also be utilized. Among them, those wherein the attached alkyl group (R) has 1 to 12 carbon atoms, are particularly attractive for the formulation of the glass cleaning composition.

Although the N-alkyl pyrrolidone can be effective at relatively low concentrations (e.g. 0.05%), a higher concentration (e.g., up to 1.5% on a weight basis) may be required for the removal of tough soils. As an example, NOP is incorporated in the composition in an amount ranging from about 0.01 to about 10% by weight of the composition. Preferably, NOP is present in an amount ranging from about 0.05 to about 2%, most preferably in an amount less than about 0.2%, but greater than about 0.1%.

However, the solubility of N-alkyl pyrrolidone is limited in aqueous based systems. Practical experience has shown that it is relatively difficult to achieve an elevated concentration of N-alkyl pyrrolidone either by direct dilution of commercially available concentrated pyrrolidones, or by dilution of aqueous, diluted solutions of the concentrates.

To overcome the aforementioned difficulty caused by low solubility of N-alkyl pyrrolidones, and to improve the overall cleaning performance of the composition, a surfactant is included in the composition. A wide range of surfactants, apparent to those skilled in the art, can be formulated into the composition. One or more surfactants can be included in the composition to provide cleaning and solubilization of the other components present in the composition. The surfactants can be amphoteric, anionic, nonionic, or a mixture thereof. Preferably such surfactants are selected from a group of surfactants that enhance the cleaning performance of the composition without causing or promoting streaking.

Amphoteric surfactants suitable for use include, for example, betaines, alkyl imidazolines, cocoamphopropionates, or combinations thereof. When an amphoteric surfactant is utilized, the amphoteric surfactant is preferably used under alkaline conditions to render the anionic portion of the amphoteric compound active. A preferred amphoteric surfactant is disodium cocoamphodipropionate (also known as cocoimidazoline carboxylate) such as that sold under the tradename MacKAM 2CSF and is present in an amount ranging from about 0.01 to about 10%.

Suitable nonionic surfactants for use in the cleaning composition include alkoxylated alcohols, alkoxylated ether phenols, silicone-based compounds such as silicone glycol copolymers, and semi-polar nonionic surfactants such as trialkyl amine oxides. One preferred nonionic surfactant is alkyl polyglycoside (APG) and is present in an amount ranging from about 0.01 to about 10%.

Suitable anionic surfactants for use include alkyl sulfates, alkyl benzenesulfonates, alkyl taurates, alkyl sacrosinates, alkyl diphenyloxide disulfonates, alkyl naphthalene sulfonates, alkyl ether sulfates, alkyl ether sulfonates, sulfosuccinates, and other anionic surfactants as known for use in cleaning compositions. The surfactants are typically available as the alkali metal, alkaline earth and ammonium salts thereof. Preferred anionic surfactants are alkyl benzenesulfonates such as sodium dodecylbenzenesulfonate (SDBS) and are present in an amount ranging from about 0.01 to about 10%.

Preferably, an amphoteric or non-ionic surfactant, or a combination of both is used. The one or more surfactants are present in an amount ranging from about 0.01 to about 10%, more preferably about 0.01 to about 3%, and most preferably about 0.01 to about 0.6%.

In addition to the ethylene glycol ether, N-alkyl pyrrolidone and surfactant, one or more additional component can be incorporated in the formulation to enhance the cleaning and/or aesthetic qualities of the cleaning composition. Suitable additional components include pH adjusting agents, hydrotropes, dyes, fragrances, buffers, antimicrobial agents, and the like as known for use in cleaning compositions. Additional components are typically present in low amounts, e.g. below about 5%.

Suitable pH adjusting agents include conventional acids, bases, and salts thereof, such as, ammonia, alkali metal hydroxides, silicates, borates, carbonates, bicarbonates, citrates, citric acid, or mixtures thereof. The $C_{2-4}$ alkanolamines includes, but not limited to, monoethanolamine (MEA), diethylaminoethanol (DEAE), aminomethylpropanol (AMP), and aminomethylpropanediol (AMPD). The cleaning composition of the invention preferably has a pH in the range of about 7 or above, more preferably in the range of from about 7.5 to about 13, and most preferably from about 10 to about 11.5. Sufficient pH modifying agent is incorporated to obtain the desired pH, and should be compatible with the streak-free cleaning aspect of the disclosed formulations. Preferably, aqueous ammonia is employed to adjust the pH to the aforementioned range. Generally, the amount of pH modifying agent ranges from about 0.01 to about 2%.

A hydrotrope component, if required, may be incorporated in an amount to stabilize other surfactants in order to allow them to remain soluble. Preferred hydrotropes are alkali metal salts of aromatic sulfonates, e.g., sodium xylene sulfonate, sodium toluene sulfonate, etc. Another class of hydrotropes is certain dicarboxylic acids. The hydrotrope is generally present in an amount less than 5%, preferably less than 1%, by weight of the composition. It has been found, however, that the disclosed compositions often do not require a hydrotrope.

Buffers are also useful optional components of the cleaning composition to maintain pH within a desired range. Such buffers are present in an amount to maintain the pH within such range, typically from about 0.001 to about 1%.

Other additional components include dyes in an amount ranging from about 0.001 to about 1%, and perfumes in an amount ranging from about 0.001 to about 1%, the amounts being such as to achieve a desired hue or scent, but without compromising the streak-free cleaning performance of the composition.

The composition of the present invention may be applied as a liquid spray. It may also be applied in aerosol form, by pressurizing the composition in an aerosol can having an effective pressurizing amount of propellant.

In order to optimize the formulation, identification of key components and their contribution to the cleaning performance of the glass cleaning composition is needed, such cleaning performance including streak reduction and soil removal. The streak reducing performance of a composition is reflected by an index designated hereinafter as "Streak", which is determined by a panel evaluation on a 0 to 5 scale with 0 being the best. The soil removal performance of a composition is reflected by an index designated hereinafter as "GKS", wherein the GKS index is given as the ratio of removal of a greasy kitchen soil (GKS) produced by the cleaning composition to that produced by a commercial all-purpose cleaner. Another important parameter for the formulation of a cleaning composition is cloud point (CP), which is the temperature at which a solution of a surfactant or glycol starts to form micelles (molecular agglomerates), thus becoming cloudy. This behavior is characteristic of nonionic surfactants and some glycols, which are often soluble at low temperatures but "cloud out" at some point as the temperature is raised. As a result, a higher cloud point is desired for a cleaning composition comprising a nonionic surfactant, a glycol, or a mixture of both. A Monte Carlo approach is utilized to screen a total of seven potential components consisting of EGHE, NOP, a co-solvent, a pH adjusting agent, and three surfactants (FIG. 3). In that experiment, a total of 20 formulations are randomly generated by a computer program, wherein each formulation comprises a randomly selected combination of the seven components, each of the selected component assigned a random concentration. The Cp, Streak and GKS index of each of the 20 formulations is obtained and the collective data processed by a software. Consequently, of the seven components, EGHE, NOP, MacKam 2CSF, and APG are identified as the four components that contributes most to an improved GSK index, while MacKam 2CSF and APG are most effective in raising the CP of the formulation (FIG. 4).

Screening designs such as the aforementioned Monte Carlo example do not allow determination of synergisms between variables. To identify and investigate a potential synergetic effect of a formulation containing the aforementioned four important components, a four variable D-optimal Design is employed with EGHE, NOP, MacKam 2CSF and APG as the four variables. As the four components had the largest positive effects on soil removal and streak reduction, an orthogonal, multilevel design to obtain good regression models that can be used to characterize the synergisms and predict optimal formulation is employed. To make the composition complete, the rest of formulation includes 0.6% MEA, 3% isopropanol, 0.1% SDBS, and water.

A total of 19 formulations are evaluated to obtain their respective Streaking and GSK indexes (FIG. 5). The collective data is processed by JMP® software to generate a plurality of response surfaces that characterize a strong and unexpected synergetic effect among EGHE, NOP, and MacKam 2CSF, with respect to soil removal performance of a cleaning composition comprising those three components (FIG. 6-8).

Figure 6:
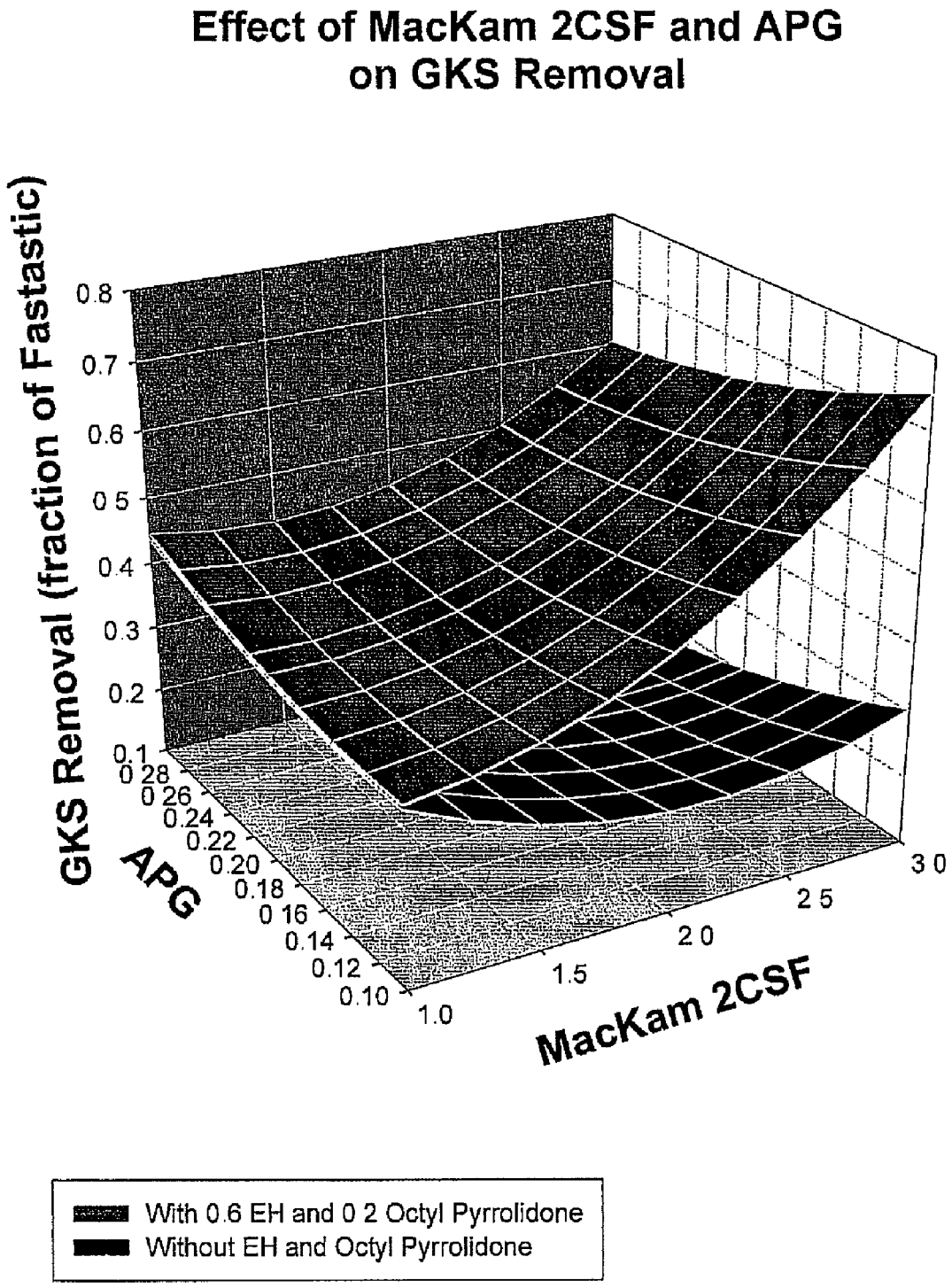
FIG. 6 graphically illustrates the effects of MacKam 2CSF and APG on soil removal performance of a composition with or without a mixture of 0.6% EGHE and 0.2% NOP.

FIG. 6 illustrates the effects of MacKam 2CSF and APG on soil removal performance of a composition with or without a mixture of 0.6% EGHE and 0.2% NOP included therein. As indicated by the response surface in FIG. 6, without the mixture in the composition, the best soil removal performance is achieved with a high level of APG and low level of MacKam 2CSF. However, increasing the concentration of the APG in the formulation does not significantly affect the soil removal performance of the composition. On the other hand, with the mixture included in the composition, the soil removal performance of a composition improves significantly with increasing MacKam 2CSF concentration. Similarly, increasing the concentration of APG does improve the soil removal performance of a composition with the inclusion of the mixture. Maximum soil removal performance is achieved by a composition comprising 0.6% EGHE, 0.2% NOP, and 3% MacKam 2CSF. As a result, a high level of MacKam 2CSF and low level of APG is desired for an optimal formulation.

Figure 7:
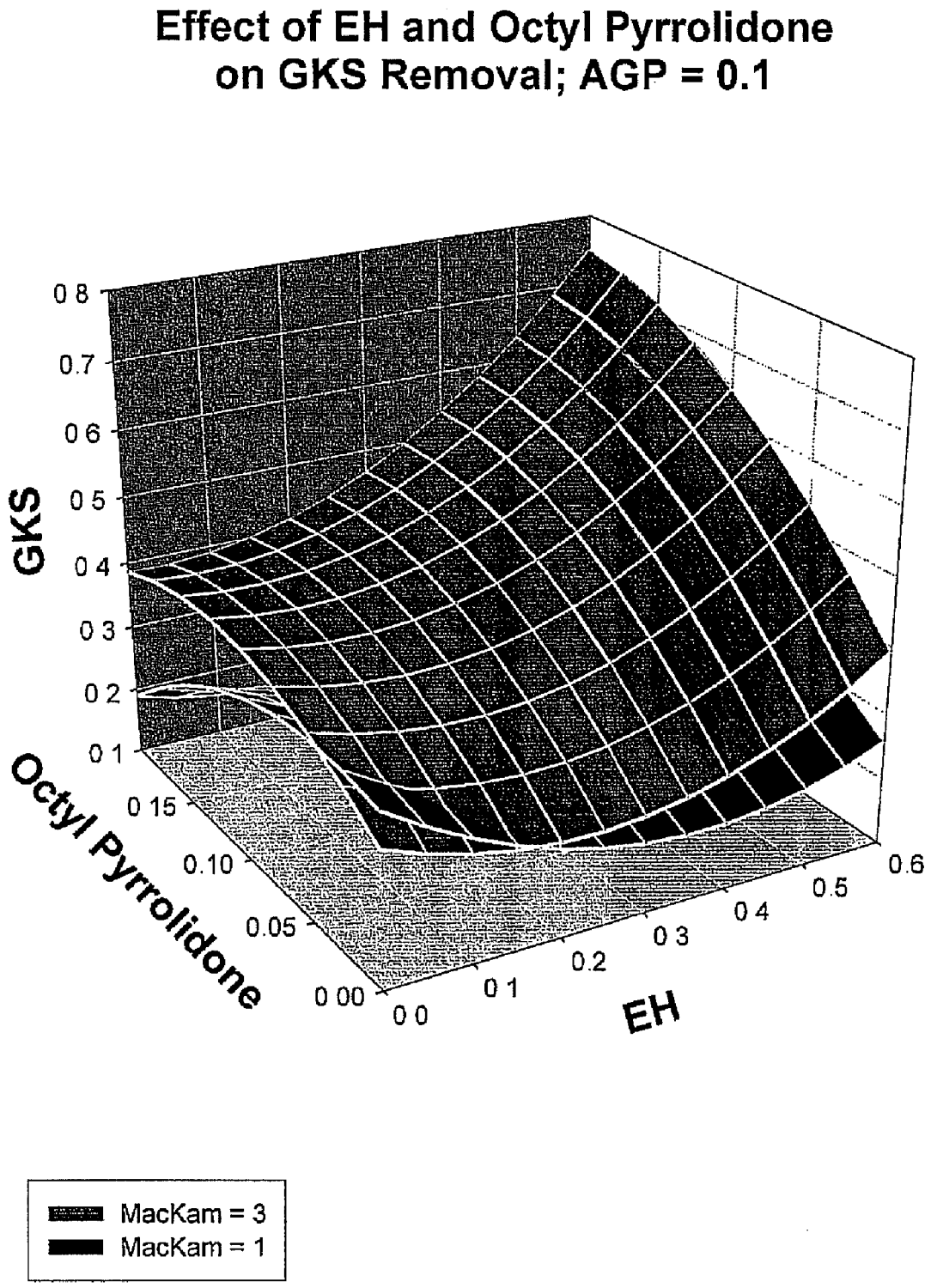
FIG. 7 graphically illustrates the effect of EGHE, NOP, and MacKam 2CSF on the soil removal performance of a composition.

FIG. 7 illustrates a synergetic effect of EGHE, NOP, and MacKam 2CSF on the soil removal performance of a composition. As indicated by the response surface in FIG. 7, a composition comprising NOP and MacKam 2CSF, but no EGHE, exhibits relatively low soil removal performance and the performance does not improve significantly with increasing either NOP or MacKam 2CSF, or both. Similarly, a composition comprising EGHE and MacKam 2CSF, but no NOP, also exhibits relatively low soil removal performance and the performance does not improve significantly with increasing either EGHE or MacKam 2CSF, or both. Moreover, a composition comprising EGHE and NOP, but a low level of MacKam 2CSF, exhibits relatively low soil removal performance and the performance does not improve significantly with increasing either EGHE or NOP, or both. A composition comprising EGHE, NOP, and MacKam 2CSF, however, significantly enhances the soil removal performance of the composition which is characterized by significant improvement of GSK removal by increasing the concentration of each one of the aforementioned components. Therefore, a strong and unexpected synergetic effect of combining EGHE, NOP, and MacKam 2CSF is identified and characterized. FIG. 6 and FIG. 7 also illustrate that a maximum soil removal performance can be achieved with a composition comprising 0.6% EGHE, 0.2% NOP, and 3% MacKam 2CSF.

Figure 8:
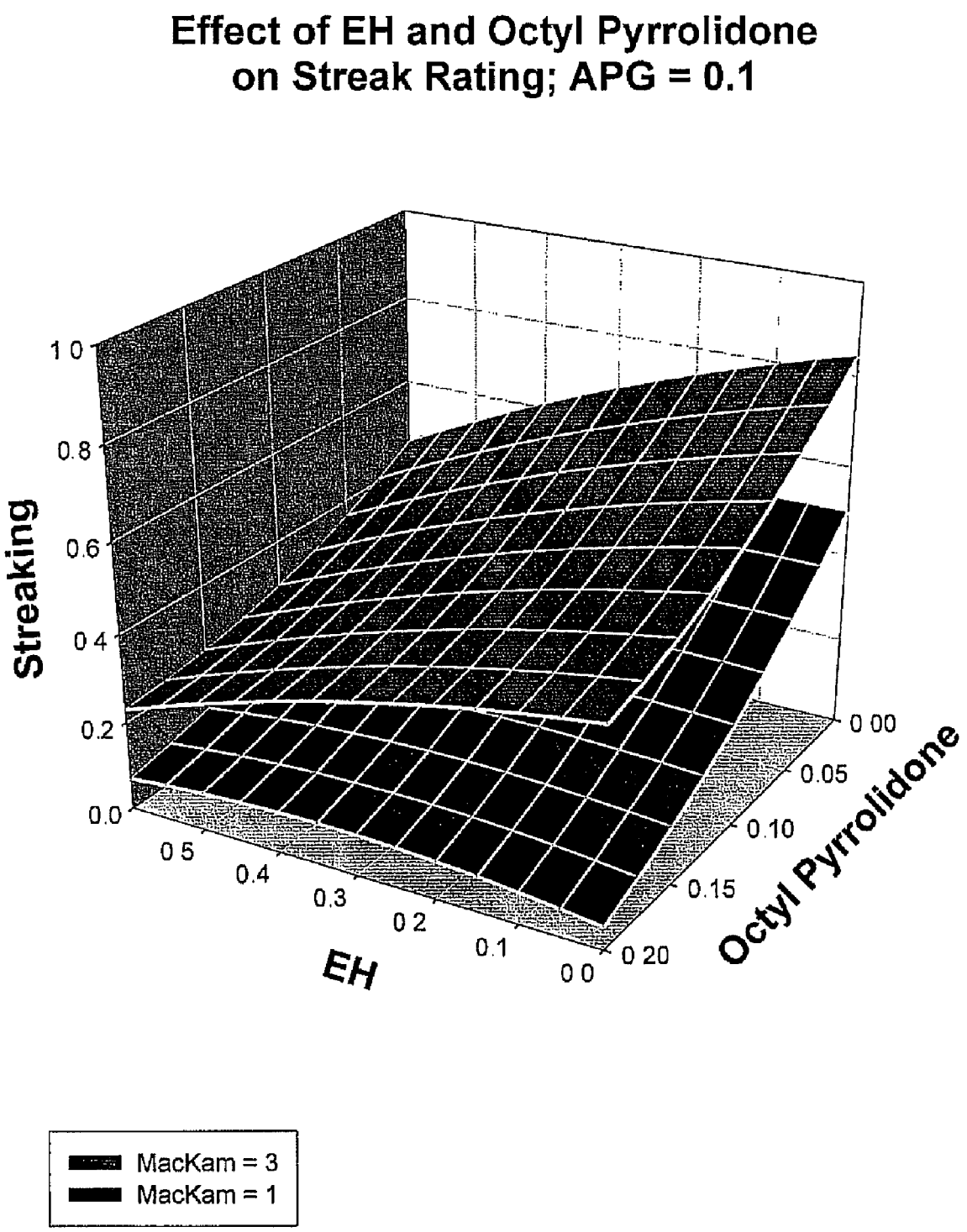
FIG. 8 graphically illustrate the effect of EGHE, NOP, and MacKam 2CSF on streak reducing performance of the composition.

FIG. 8 illustrate the effect of EGHE, NOP, and MacKam 2CSF on streak reducing performance of the composition. Overall, increasing the concentration of MacKam 2CSF, which is beneficial to the soil removal performance of the composition, increases streak. At a lower concentration of MacKam 2CSF, streak reduction is relatively independent of the concentration of EGHE although increasing the concentration of NOP significantly reduces streaking. At a higher concentration of MacKam 2CSF, however, significant reduction of streak is achieved with increasing the concentration of either EGHE or NOP, or both. When the concentration of MacKam 2CSF is about 3%, best streak reducing performance is represented by a composition comprising 0.2% NOP, and 0.6% EGHE.

To summarize, an unexpected synergetic effect is established with the combination of EGHE, NOP, and MacKam 2CSF, with respect to the soil removal performance and low streaking. Significant improvement of soil removal is achieved by increasing the concentration of EGHE and/or NOP and/or MacKam 2CSF. On the other hand, although the increasing of the concentration of EGHE and/or NOP reduces streaking of the composition, increasing the concentration of MacKam 2CSF increases streaking of same. Moreover, increasing the concentration of NOP is more effective than increasing the concentration of EGHE with respect to the streak reducing performance of the composition although the effects are about equal when cost of the ingredients becomes a factor.

In an embodiment, a glass cleaning composition comprises an ethylene glycol ether, an N-alkyl pyrrolidone, a surfactant, and optionally a co-solvent such as a monohydric or dihydric alcohol, a pH adjusting agent such as ammonia, a buffer, a dye, an antimicrobial agent, and a fragrance.

In a refinement, a glass cleaning composition comprises an ethylene glycol ether, an N-alkyl pyrrolidone, and a surfactant, wherein the surfactant is chosen from a group consisting of an amphoteric surfactant, an non-ionic surfactant, an anionic surfactant or a mixture thereof.

In another refinement, a glass cleaning composition comprises from about 0.1 to about 5% of an ethylene glycol ether, from about 0.05 to about 2% of an N-alkyl pyrrolidone, and from about 0.01 to about 10% of a mixture of an amphoteric surfactant, an nonionic surfactant, and an anionic surfactant.

In yet another refinement, a glass cleaning composition comprises from about 0.1 to about 1% of an ethylene glycol ether, from about 0.05 to about 1% of an N-alkyl pyrrolidone, and from about 0.01 to about 10% of a mixture of MacKam 2CSF, APG and SDBS.

In one preferred embodiment, a glass cleaning composition comprises from about 0.1 to about 1% EGHE, from about 0.05 to about 1% NOP, and from about 0.01 to about 10% of a mixture of MacKam 2CSF, APG and SDBS. The composition may further comprise about 3% isopropanol as a co-solvent, 0.3% ammonia as a pH adjusting agent and about 0.05% fragrance.

In a refinement a glass cleaning composition comprises 0.3% EGHE, 0.1% NOP, 2% MacKam 2CSF, 0.2% APG and 0.1% SDBS. The composition may further comprises about 3% isopropanol as a co-solvent, a mixture of 0.3% ammonia and 0.6% MEA as a pH adjusting agent and about 0.05% fragrance. The composition exhibits a 0.18 GSK index and a 0.63 Streak index as compared to a 0.16 GSK index and a 0.03 Streak index exhibited by a commercial glass cleaning composition.

In another refinement, a glass cleaning composition comprises 0.6% EGHE, 0.1% NOP, 1% MacKam 2CSF, 0.3% APG and 0.1% SDBS. The composition further comprises about 3% isopropanol as a co-solvent, a mixture of 0.3% ammonia and 0.6% MEA as a pH adjusting agent and about 0.05% fragrance. The composition exhibits a 0.50 GSK index which is a significant improvement over a commercial glass cleaning composition. However, it also exhibited a 0.43 Streak index which is a significant increment over the 0.03 exhibited by the commercial glass cleaning composition.

In a most preferable embodiment, a glass cleaning composition comprises 0.6% EGHE, 0.2% NOP, 3% MacKam 2CSF, 0.1% APG and 0.1% SDBS. The composition further comprises about 3% isopropanol as a co-solvent, a mixture of 0.3% ammonia and 0.6% MEA as a pH adjusting agent and about 0.05% fragrance. The composition exhibits a 0.75 GSK index and a 0.23 Streak index, which translates into a significant improvement in soil removal performance of the composition, wherein the composition still remains acceptably streak-free.

While only certain embodiments have been set forth, alternative embodiments and various modifications will be apparent from the above descriptions of those skilled in the art. These and other alternatives are considered equivalents and within the spirit and scope of this disclosure.

What is claimed is:

1. An improved glass cleaning composition comprising:

an ethylene glycol ether having a formula of $HO(CH_2CH_2O)_nR$, wherein n is an interger ranging from 1 to 2 and R is a $C_{1-10}$ alkyl group, and wherein the ethylene glycol ether is present in an amount ranging from about 0.01 to about 10 wt %;

an N—$C_{1-12}$ alkyl pyrrolidone in an amount ranging from about 0.01 to about 10 wt %;

a surfactant selected from the group consisting of amphoteric surfactants, alkyl polyglycosides, and mixtures thereof; and water.

2. The composition of claim 1 wherein the ethylene glycol ether is ethylene glycol monohexyl ether.

3. The composition of claim 1 wherein the N—$C_{1-12}$ alkyl pyrrolidone is N-octyl pyrrolidone.

4. The composition of claim 1 further comprising an anionic surfactant.

5. The composition of claim 1 wherein the amphoteric surfactant is disodium cocoamphodipropionate.

6. The composition of claim 1 wherein the surfactant is present in an amount ranging from about 0.01 to about 10 wt %.

7. The composition of claim 1 wherein the composition further comprises a co-solvent, the co-solvent comprising at least one of a $C_{1-4}$ alcohol and a $C_{2-6}$ alkylene glycol.

8. The composition of claim 1 wherein the composition further comprises a pH adjusting agent.

9. The composition of claim 8 wherein the pH adjusting agent comprises at least one of ammonia and an organic base.

10. The composition of claim 1 wherein the composition further comprises an antimicrobial agent.

11. An improved glass cleaning composition comprising:

ethylene glycol monohexyl ether in an amount ranging from about 0.01 to about 10 wt %;

N-octyl pyrrolidone in an amount ranging from about 0.01 to about 10 wt %;

a surfactant; and water.

12. The composition of claim 11 wherein the surfactant comprises at least one of an amphoteric surfactant, a nonionic surfactant, and an anionic surfactant.

13. The composition of claim 11 wherein the amphoteric surfactant is disodium cocoamphodipropionate.

14. The composition of claim 11 wherein the nonionic surfactant is an alkyl polyglycoside.

* * * * *